US011128051B2

(12) United States Patent
Salman

(10) Patent No.: US 11,128,051 B2
(45) Date of Patent: Sep. 21, 2021

(54) MULTI-FREQUENCY ELECTROMAGNETIC FEED LINE

(71) Applicant: Metawave Corporation, Carlsbad, CA (US)

(72) Inventor: Safa Kanan Hadi Salman, Vista, CA (US)

( * ) Notice: Subject to any disclaimer, the term of this patent is extended or adjusted under 35 U.S.C. 154(b) by 0 days.

(21) Appl. No.: 16/698,637

(22) Filed: Nov. 27, 2019

(65) Prior Publication Data

US 2020/0168998 A1 May 28, 2020

Related U.S. Application Data

(60) Provisional application No. 62/772,172, filed on Nov. 28, 2018, provisional application No. 62/789,847, filed on Jan. 8, 2019.

(51) Int. Cl.
*H01Q 13/18* (2006.01)
*H01Q 21/00* (2006.01)

(52) U.S. Cl.
CPC ..... *H01Q 13/18* (2013.01); *H01Q 21/0006* (2013.01)

(58) Field of Classification Search
CPC ..... H01Q 13/18; H01Q 21/00
See application file for complete search history.

(56) References Cited

U.S. PATENT DOCUMENTS 6,429,825 B1 * 8/2002 Martek ..... H01Q 13/18 343/770
2006/0066495 A1 * 3/2006 Isoifovich ..... H01Q 13/106 343/770
2015/0222023 A1 * 8/2015 Shijo ..... G01S 7/03 342/195
2021/0013621 A1 * 1/2021 Nakamoto ..... H01Q 21/005

OTHER PUBLICATIONS

Mac-Intosh-Hobson, Bronte, "Slotted Substrate Waveguide Array & Feed System", Aug. 2008, 116 pages, Published Heritage Branch, Canada.

(Continued)

*Primary Examiner* — Lam T Mai
(74) *Attorney, Agent, or Firm* — Sandra Lynn Godsey

(57) ABSTRACT

Examples disclosed herein relate to a multi-frequency electromagnetic feed line. The multi-frequency electromagnetic feed line includes a waveguide that has a plurality of slots arranged laterally along a length of the waveguide that corresponds to a first axis, in which the plurality of slots are configured to radiate electromagnetic signaling from an input end of the waveguide to a terminal end of the waveguide. The waveguide also has a plurality of vias arranged proximate to the terminal end of the waveguide in a predetermined angle relative to a second axis orthogonal to the first axis, in which the plurality of vias are configured to terminate the plurality of slots for different frequencies of an operating frequency band. A first slot of the plurality of slots that is arranged closest to the terminal end has varying distances to different vias. Other examples disclosed herein relate a method of fabricating a waveguide.

20 Claims, 8 Drawing Sheets

(56) References Cited

OTHER PUBLICATIONS

Maritz, Andries Johannes Nicolaas, "Investigation and Design of a Slotted Waveguide Antenna with Low 3D Sidelobes", Mar. 2010, 121 pages, Stellenbosch University.
Rajo-Iglesias, Eva et al., Design of Planar Arrays with Groove Gap Waveguide Technology Implemented with Glide-Symmetric Holey Structures, 2018.
Deslandes, Dominic et al., "Integrated Translation of Coplanar to Rectangular Waveguides", 2001, IEEE MTT-S Dig Phoenix, pp. 619-622, vol. 2., Canada.
Bhatti, Rashid Ahmad et al., "Design of a Planar Slotted Waveguide Array Antenna for X-Band Radar Applications", Jun. 2011, J. of the Korean Institute of Electromagnetic Engineering and Science, vol. 11, No. 2, pp. 97-104.
Park, Sehyun et al., "A Slotted Post-Wall Waveguide Array with Interdigital Structure for 45 degree Linear and Dual Polarization", IEEE Transactions on Antennas and Propagation, vol. 53, No. 9, Sep. 2005, pp. 2865-2871.
Nicholson, Kelvin J., Tunable Metamaterials for the Slotted Waveguide Antenna Stiffened Structure, RMIT University, Mar. 2014, 164 pages, Australia.
Misilmani, Hilal M. El, "Design of Slotted Waveguide Antennas with Low Sidelobes for High Power Microwave Applications", Progress in Electromagnetics Research C., vol. 56, pp. 15-28, 2015.
Yee, Hung Y., "Impedence of a Narrow Logitudinal Shunt Slot in a Slotted Waveguide Array", IEEE Transactions on Antennas and Propagation, vol. 22, Issue 4, Jul. 1974.

* cited by examiner

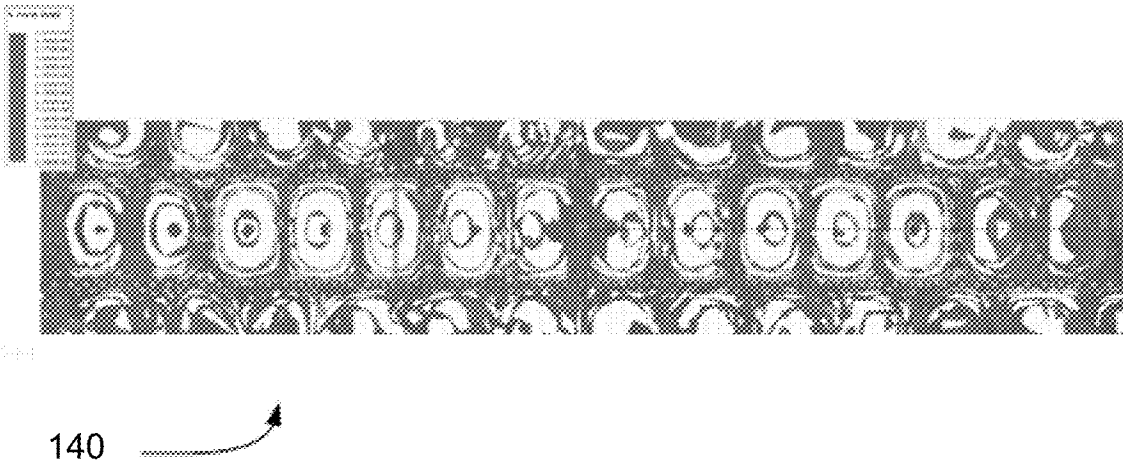
FIG. 3
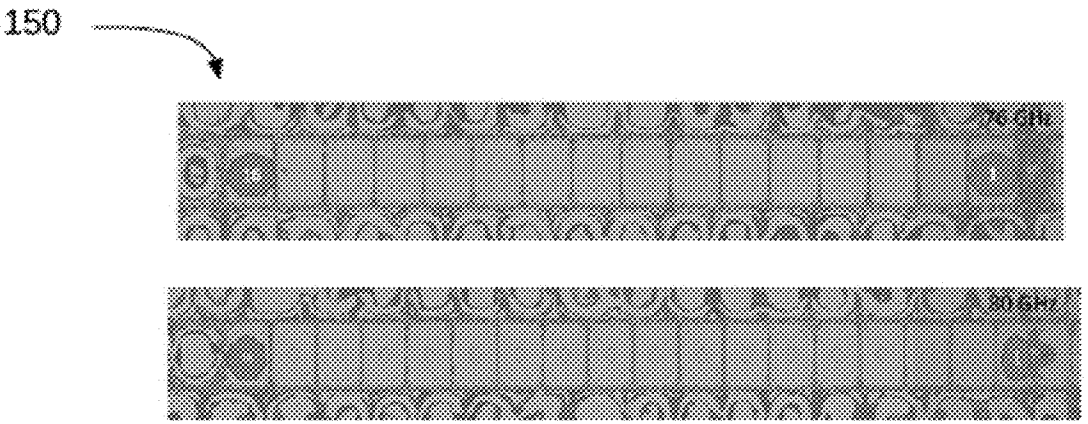
FIG. 4
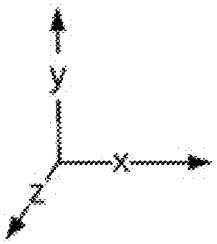

MULTI-FREQUENCY ELECTROMAGNETIC FEED LINE

CROSS-REFERENCE TO RELATED APPLICATIONS

This application claims priority from U.S. Provisional Application No. 62/772,172, titled "METHOD AND APPARATUS FOR A MULTI-FREQUENCY ELECTROMAGNETIC FEED LINE," filed on Nov. 28, 2018, and U.S. Provisional Application No. 62/789,847, titled "METHOD AND APPARATUS FOR A MULTI-FREQUENCY ELECTROMAGNETIC FEED LINE," filed on Jan. 8, 2019, all of which are incorporated by reference herein.

BACKGROUND

In systems incorporating waveguides, it is desirable to provide stability, good matching and reduced energy loss. There are a variety of forms and designs for waveguides, as they are basic to many different applications. These applications are designed to operate at one frequency. There is a desire for a waveguide that maintains performance over a frequency range.

BRIEF DESCRIPTION OF THE DRAWINGS

The present application may be more fully appreciated in connection with the following detailed description taken in conjunction with the accompanying drawings, which are not drawn to scale, in which like reference characters refer to like parts throughout, and in which:

FIGS. 3 and 4 illustrate electromagnetic field patterns for portions of a waveguide, according to implementations of the subject technology;

DETAILED DESCRIPTION

Figure 1:
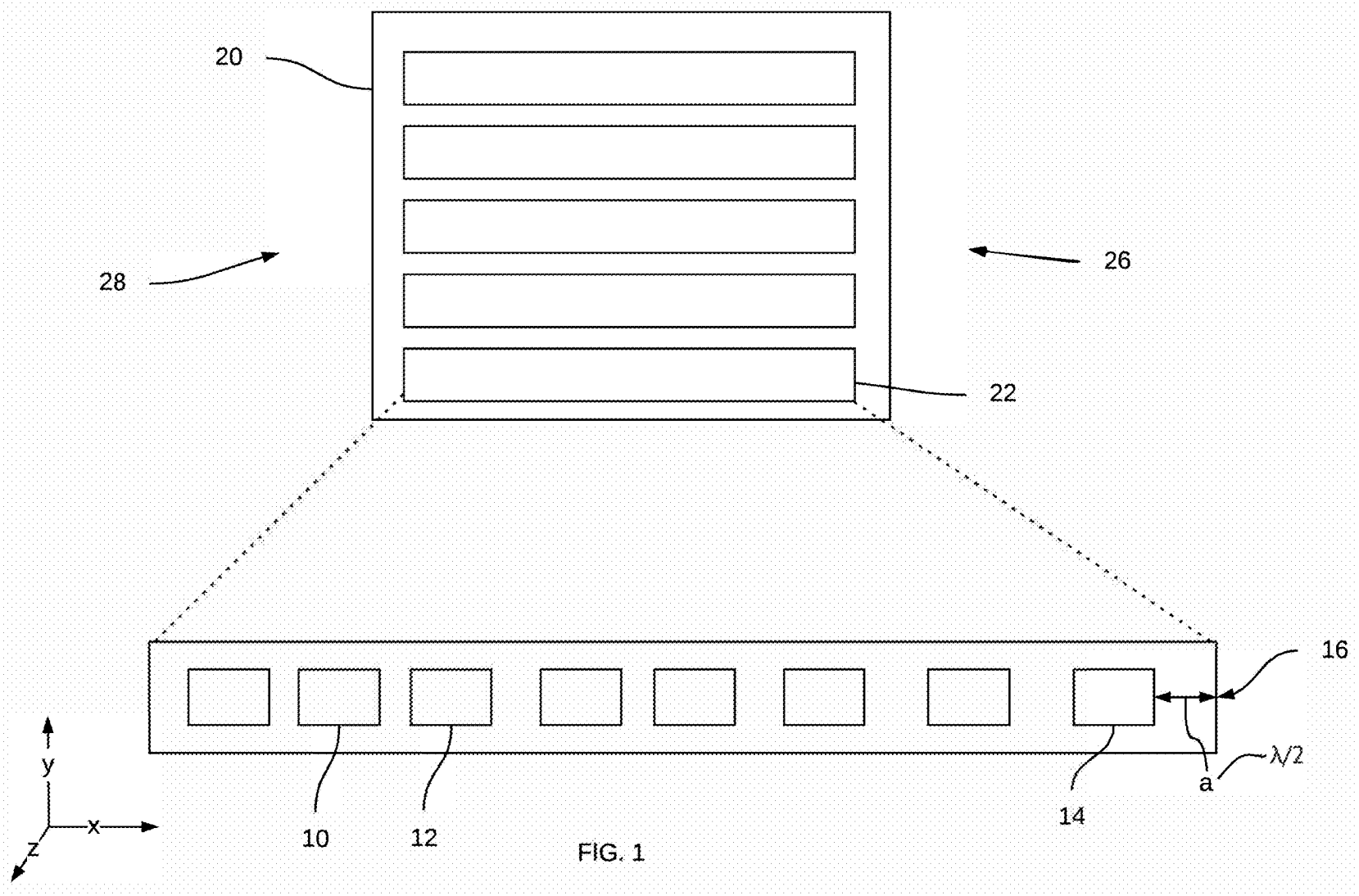
FIG. 1 illustrates a radiating structure having multiple waveguides, according to implementations of the subject technology.

The present disclosure provides methods and apparatuses to enable reliable, accurate propagation of electromagnetic waves. Such feed lines, referred to herein as waveguides and/or transmission lines, are commonly used in wireless devices to provide signal processing. In most systems, the feed lines are configured and designed to operate at a frequency, in which operation degrades as the frequency changes. For operation of a device or design of a feed line for multiple devices, it is desired to avoid such degradation and provide approximately similar operation. This means that matching and stability are not impacted by the change in frequency. Typical feed lines have termination ends that are approximately perpendicular to the slots or radiating elements formed therein.

A first objective of the subject technology is to broaden the gain performance bandwidth. A second objective of the subject technology is to reduce fluctuation in gain over the bandwidth of interest. In the examples provided herein, the improvement is considered at 80 GHz, but the methods presented herein may be used at other frequencies. The subject technology improves the gain while maintaining peak realized gain on the edge and interior elements of a radiating array.

In some implementations of the subject technology, the multi-frequency electromagnetic feed line is a waveguide that has a plurality of slots arranged laterally along a length of the waveguide that corresponds to a first axis, in which the plurality of slots are configured to radiate electromagnetic signaling from an input end of the waveguide to a terminal end of the waveguide. The waveguide also has a plurality of vias arranged proximate to the terminal end of the waveguide in a predetermined angle relative to a second axis orthogonal to the first axis, in which the plurality of vias are configured to terminate the plurality of slots for different frequencies of an operating frequency band. In some aspects, a first slot of the plurality of slots that is arranged closest to the terminal end has varying distances to different vias of the plurality of vias.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, the subject technology is not limited to the specific details set forth herein and may be practiced using one or more implementations. In one or more instances, structures and components are shown in block diagram form in order to avoid obscuring the concepts of the subject technology. In other instances, well-known methods and structures may not be described in detail to avoid unnecessarily obscuring the description of the examples. Also, the examples may be used in combination with each other.

FIG. 1 illustrates a radiating structure 20 having multiple waveguides 22. Each of the waveguides 22 includes multiple slots 10, 12, 14 formed along the length of the waveguide. In the illustrated implementation, the slots 10, 12, 14 are discontinuous openings through which a signal radiates. The slot 14 may be represented as a terminal slot that is positioned at a distance a from a terminal end 16. To reduce reflections and thus improve matching, the spacing a is determined according to the frequency, in which $a=\lambda/2$. When a signal of a different frequency is presented to the waveguide, the matching and performance degrades.

The structure 20 includes multiple waveguides 22 configured with respective lengths along the x-axis as defined herein. The waveguides 22 are placed adjacent one another in the y-direction as defined herein. In some implementations, the structure 20 has an input end 28 and a terminal end 26, where the signal is provided to the radiating structure 20 from a source (not shown) to the input end 28. The terminal end 26 corresponds to where the waveguides 22 terminate, and may not connect further to any load in some implementations. The behavior of signals propagating through and radiating from the radiating structure 20 is different for interior portions and terminal portions of the radiating structure 20. In other implementations, the radiating structure 20 can be fed from its center and terminated on both ends.

Figure 2:
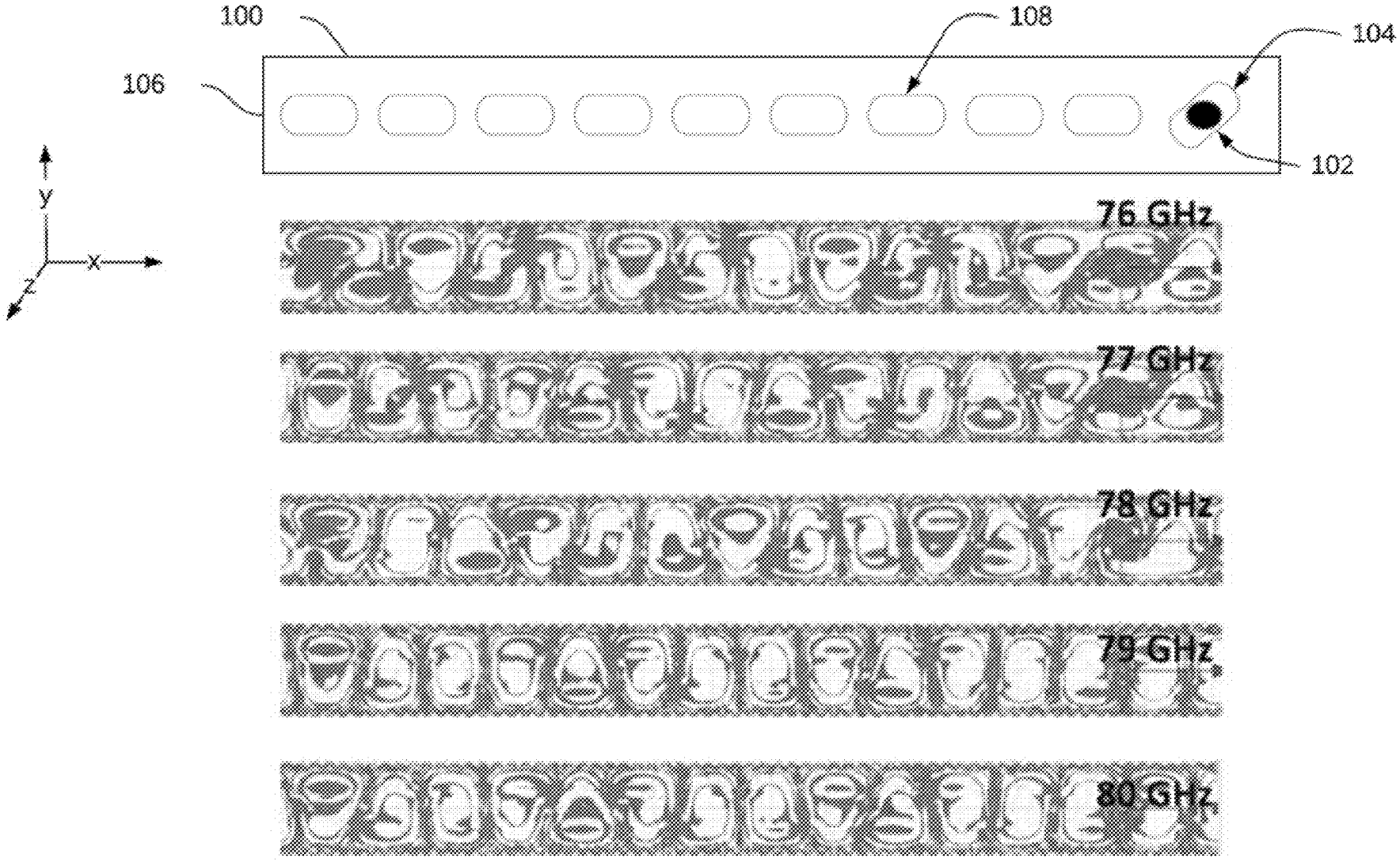
FIG. 2 illustrates transmission patterns for portions of a waveguide, according to implementations of the subject technology.

FIG. 2 illustrates transmission patterns for portions of a waveguide, according to implementations of the subject technology. The waveguide 100 has multiple slots 108 arranged along the x-axis and a terminal end 106. The waveguide 100 also has a feed slot 104 configured to receive input signals at point 102. FIG. 2 also depicts field distribution patterns for the electric field (E-field) of the waveguide 100 for multiple different frequency input signals, including 76 GHz, 77 GHz, and up to 80 GHz. These frequencies are illustrated as examples of millimeter wave transmissions. As illustrated, the E-field patterns that result from each frequency can change significantly and may not provide a common range of high gain. In this example, the feed slot 104 is set at a predetermined angle relative to the other slots in the feed structure; however, this configuration of the feed slot 104 as arranged in the waveguide 100 may not allow slots 108 to radiate in-phase for the set of frequencies provided as inputs. In other words, this configuration has a limited range for consistent operation. The design goal is to provide a configuration that allows in-phase radiation patterns at each frequency in the bandwidth range. In some prior approaches, the number of slots in a waveguide is reduced to achieve some level of in-phase alignment.

FIGS. 3 and 4 illustrate electromagnetic field patterns 140, 150 for portions of a waveguide, according to implementations of the subject technology. In FIG. 3, the E-field pattern 140 corresponds to a reduced number of slots in the waveguide, which in this example represents 8 slots. The E-field pattern 140 overlays multiple frequency responses on top of each other. These slots radiate in-phase at these frequencies and appear substantially aligned. In FIG. 4, the E-field pattern 150 corresponds to a waveguide without slots. The E-field pattern 150 includes a first pattern at 76 GHz and a second pattern at 80 GHz. However, as frequencies go outside of a given range, misalignment begins to appear. To align field patterns over more frequencies, the subject technology provides for terminating the waveguide relative to a last slot in the sequence that corresponds to the last interval, or cycle, of the E-field in the waveguide such that different distances between the termination and the last slot are adaptable to terminate the waveguide at corresponding frequencies to achieve in-phase alignment among the slots.

Figure 5:
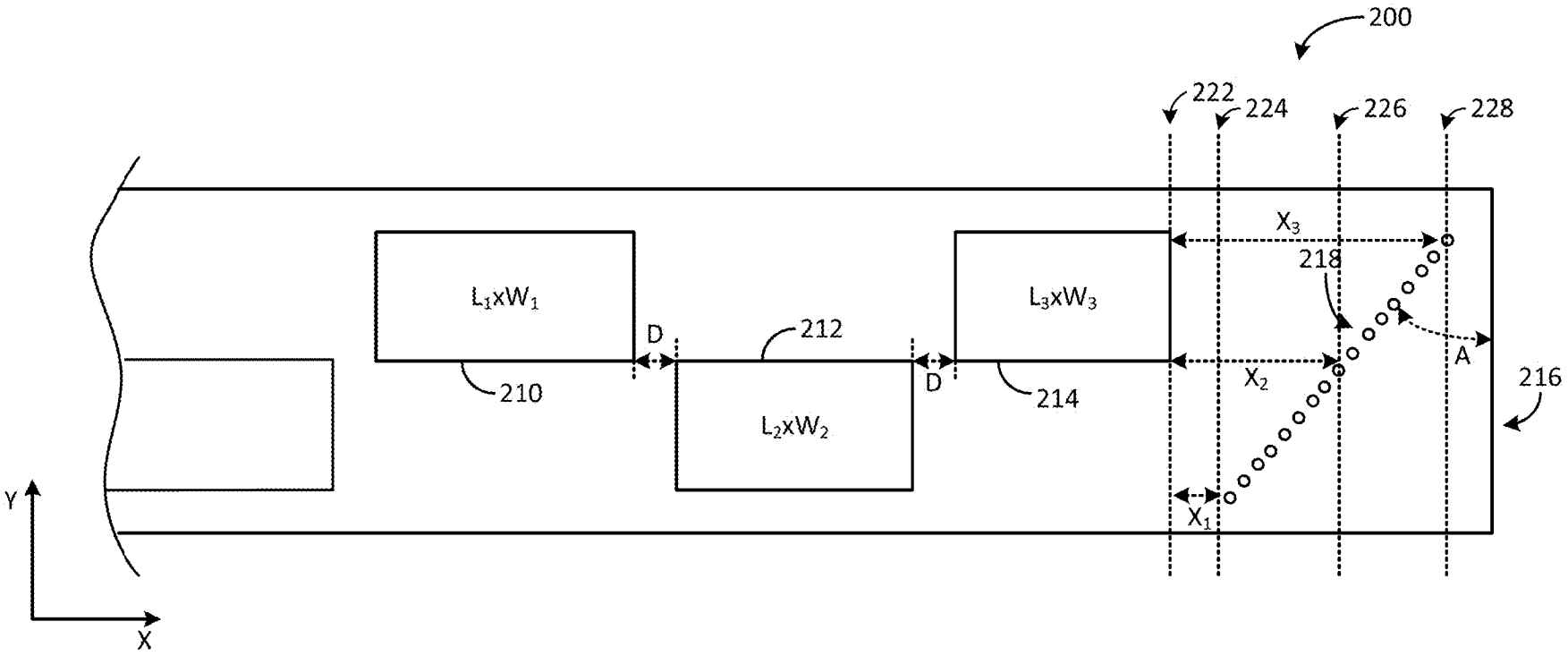
FIG. 5 illustrates a multi-frequency electromagnetic waveguide having discontinuities positioned along the length of the waveguide, according to implementations of the subject technology.

FIG. 5 illustrates a multi-frequency electromagnetic waveguide 200 having slots 210, 212 and 214 arranged laterally along the length of the waveguide (or x-axis). The waveguide 200 includes a substrate, where the slots 210, 212 and 214 may be patterned or etched in the substrate. In some implementations, the slots 210, 212 and 214 are equidistant from one another along the x-axis. For example, the slots 210, 212 and 214 may be separated by a fixed distance, D. This is to ensure the periodicity of the slots. In some implementations, the slots 210, 212 and 214 are staggered from one another along the y-axis. The dimensions of the slots 210, 212 and 214 may be determined based at least on the operational frequency. In some implementations, the slots 210, 212 and 214 have equivalent dimensions. Having equivalent dimensions for the slots would be beneficial for systems operating at one frequency. In other implementations, the slots 210, 212 and 214 have different dimensions (e.g., different lengths) such that the slots 210, 212 and 214 are tapered along the x-axis. For example, the dimensions of the slots may increase toward the center of the waveguide 200 and decrease toward the edges of the waveguide, such that slots arranged proximate to the edge of the waveguide (e.g., terminal end 216) have dimensions that are smaller than those of slots at (or proximate to) the center of the waveguide 200. As depicted in FIG. 2, slot 210 has dimensions $L_1 \times W_1$, slot 212 has dimensions $L_2 \times W_2$, and slot 214 has dimensions $L_3 \times W_3$, where slot 210 is closest to the center of the waveguide 200 and $L_1 \times W_1 > L_2 \times W_2 > L_3 \times W_3$.

In some implementations, the terminal end 216 of the waveguide 200 is enhanced by provision of a termination construct 218 to adapt to multiple frequencies. In some implementations, the termination construct 218 is formed proximate to the terminal end 216 on the waveguide 200. In the present implementation, the termination construct 218 is a linear length of vias at a predetermined angle (e.g., denoted as "A") relative to the terminal end 216 (or non-orthogonal with the y-axis). The vias of the termination construct 218 may be patterned or etched through the substrate of the waveguide 200. The number of vias in the termination construct 218 may vary depending on implementation, but may be based at least on the frequency band and any fabrication limitations. The predetermined angle may be set in a range of 0 degrees to 45 degrees based at least on the frequency band of operation. As the frequency band increases to include additional frequencies of operation, the predetermined angle for the termination construct 218 increases to provide the range of varying distances to the slot along the x-axis for in-phase alignment across the frequency band. In some implementations, the vias of the termination construct 218 are coupled to a ground plane within the waveguide 200. This allows the E-field radiation from each of the slots at a particular frequency to terminate to ground through the vias of the termination construct 218. In some implementations, the vias have a diameter of about 6 mils (or about 0.1524 mm) and the vias are separated by about 6 mils. However, the diameters of the vias and the distance between the vias may be an arbitrary number that varies depending on implementation.

The termination construct 218 is formed in the waveguide 200 such that a first distance from one end of the slot 214 to a first location on the termination construct 218 along the x-axis corresponds to a first frequency, while a second distance from the end of the slot 214 to a second location on the termination construct 218 along the x-axis corresponds to a second frequency. For example, a first distance from one end of the slot 214 at location 222 to a first location 224 on the termination construct 218 is defined as $X_1$. In another example, a second distance from the end of the slot 214 at the location 222 to a second location 226 on the termination construct 218 corresponds to $X_2$ that is greater than $X_1$. In still another example, a third distance from the end of the slot 214 at the location 222 to a third location 228 on the termination construct 218 is defined as $X_3$ that is greater than $X_2$. Each of the distances between the slot 214 and the termination construct 218 correspond to different frequencies within the operating frequency band of the waveguide 200. In this respect, the distance denoted as $X_N$ corresponds to a frequency denoted as $F_N$, which can be defined as $F_N = c/\lambda g$ and $X_N = \lambda g/2$, where c is the speed of light and $\lambda_g$ is the guide wavelength. As illustrated in FIG. 5, the distance $X_1$ is smaller than $X_2$ and $X_3$. Given that the frequency increases as the distance between the slot 214 and the termination construct 218 decreases, the distance $X_1$ corresponds to a first frequency (e.g., high frequency in the frequency band) and the distance $X_3$ corresponds to a second frequency that is smaller than first frequency (e.g., low frequency in the frequency band). The distance $X_2$ corresponds to the center frequency given that the distance, $X_2$, is the median between the distances, $X_1$ and $X_3$.

Figure 6:
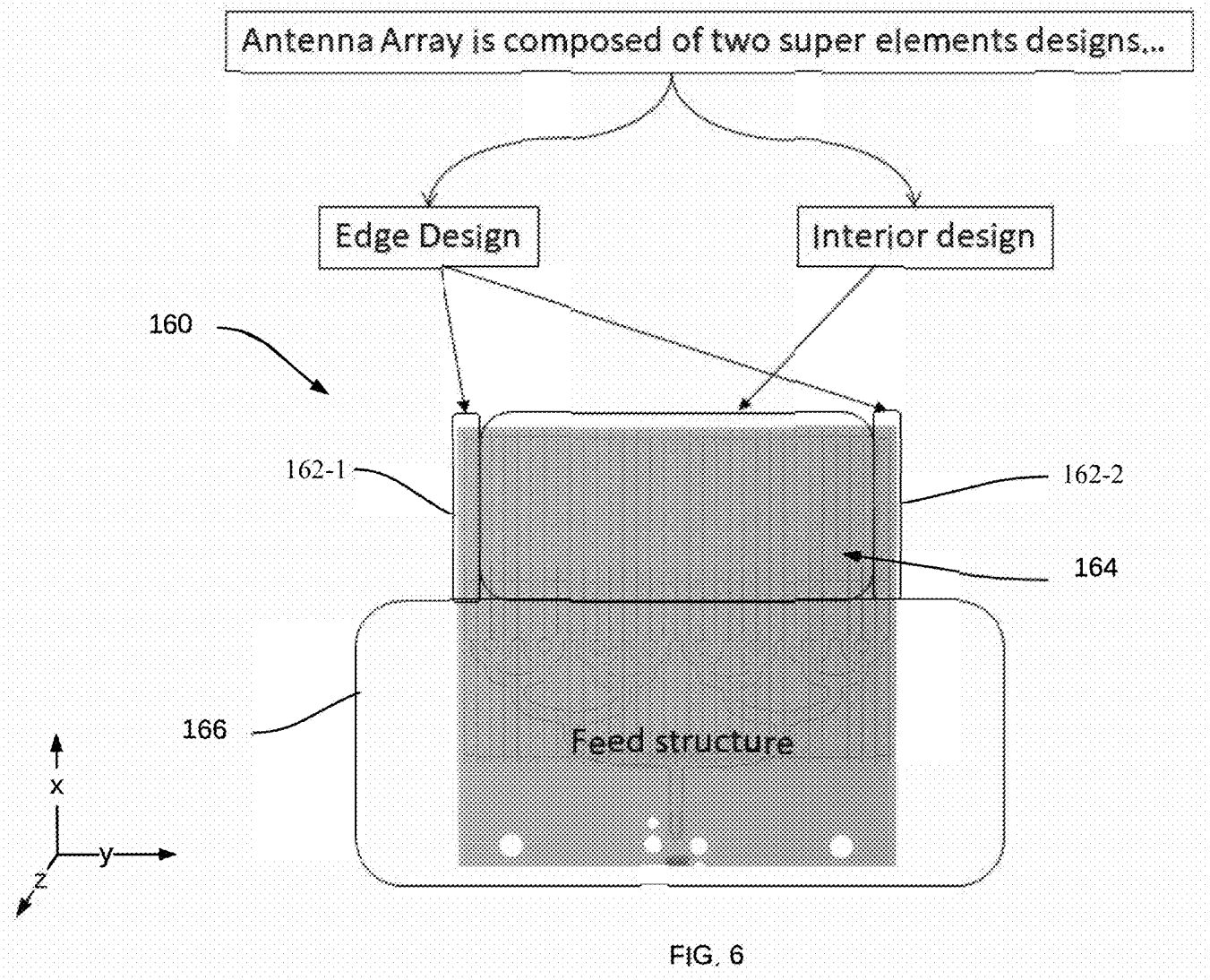
FIG. 6 illustrates a schematic diagram of an antenna array having edge-based waveguides and interior-based waveguides, according to implementations of the subject technology.

FIG. 6 illustrates a schematic diagram of an antenna array 160 having edge-based waveguides and interior-based waveguides, according to implementations of the subject technology. The antenna array 160 includes a feed structure 166 and a waveguide structure. The waveguide structure includes two portions, an interior portion 164 and exterior portions 162-1, 162-2. The exterior portions 162-1 and 162-2 include edge-based waveguides and the interior portion 164 includes interior-based waveguides. As illustrated, the feed structure 166 has distributed feed lines for coupling an input signal to the multiple waveguides in the waveguide structure. In some implementations, the interior-based waveguides in the interior portion 164 operate with a first behavior and the edge-based waveguides in the external portions 162-1, 162-2 operate with a second behavior different from the first behavior in some implementations, or that is equivalent to the first behavior in other implementations.

Figure 7:
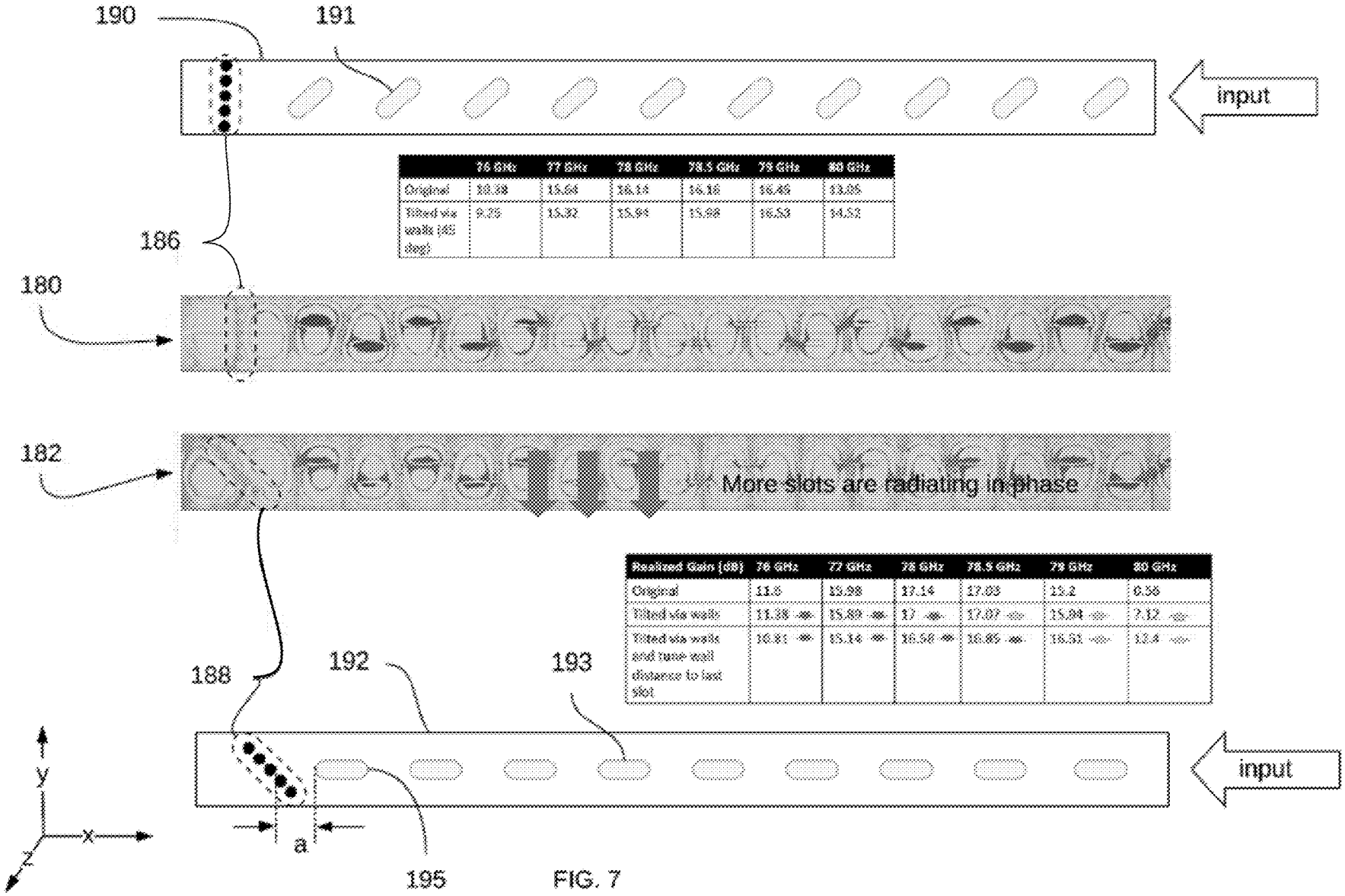
FIG. 7 illustrates waveguides having respective slot arrangements and corresponding electromagnetic field distribution patterns, according to implementations of the subject technology.

FIG. 7 illustrates waveguides having respective slot arrangements and corresponding E-field distribution patterns, according to implementations of the subject technology. A first waveguide 190 includes multiple staggered slots and a termination construct 186 having multiple vias that are arranged proximate to a first slot 191 to form an effective end wall in the waveguide 190. The termination construct 186 is arranged perpendicular to the length of the waveguide 190 along the x-axis. The slots (including slot 191) are formed laterally along the x-axis within the waveguide 190. The first waveguide 190 has a corresponding E-field distribution pattern 180 that includes radiation patterns radiating from the slots of the first waveguide 190.

For comparison, a second waveguide 192 includes multiple staggered slots (e.g., 193, 195) and a termination construct 188 having multiple vias that are arranged proximate to a first slot 195 to form an effective end wall in the waveguide 192. The termination construct 188 is arranged at a non-orthogonal angle relative to the y-axis that is orthogonal to the length of the waveguide 192 along the x-axis, where a first end of the termination construct 188 is closest to the first slot 195 while a second end (opposite to the first end) of the termination construct 188 is furthest to the first slot 195. The slots (including slots 193 and 195) are formed laterally along the x-axis within the waveguide 192. The second waveguide 192 has a corresponding E-field distribution pattern 182 that includes radiation patterns radiating from the slots of the second waveguide 192. In this example, the input signal is fed into an end of the waveguide (opposite to a terminal end where the termination constructs are located). As illustrated, the radiation pattern 182 has more slots of the waveguide 192 that radiate in phase with one another than those depicted in the radiation pattern 180.

FIG. 7 also includes tables listing data corresponding to the realized gain for each of the waveguides 190, 192 over frequencies in the set of 76 GHz, 77 GHz, 78 GHz, 78.5 GHz, 79 GHz, and 80 GHz. Each of the tables indicate original realized gain measurements for a waveguide with the termination construct arranged along the y-axis. For example, the original measurement of the realized gain in the waveguide 190 may correspond to radiation from its slots with the termination construct 186 arranged along the y-axis (or perpendicular to the length of waveguide 190); and the original measurement of the realized gain in the waveguide 192 may correspond to radiation from its the slots with the termination construct 188 arranged along the y-axis (or perpendicular to the length of the waveguide 192). As noted in each of the tables, the original measurements for each of the waveguides indicate a significant decrease in gain at the corner frequencies (e.g., 76 GHz, 80 GHz). The original measurements can be compared to the realized gain measurements with the termination constructs arranged at a tilt angle (or at a non-orthogonal angle relative to the x-axis). These measurements (denoted as "tilted via walls") show improvement of the realized across the frequency band, where the realized gain is closer aligned at the other frequencies. For example, the realized gain achieved with the tilted via wall (or termination construct 186 at the tilted angle) in the waveguide 190 appears more uniform with the exception at 76 GHz. Similarly, the realized gain in the waveguide 192 that is achieved at the corner frequencies increased to provide a more uniform gain distribution compared to the original measurements. For a further comparison to the waveguide 192, the distance, a, between the slot 195 and the termination construct 188 (denoted as "tune wall distance to last slot") is tuned to achieve desired gain results. The realized gain in the waveguide 192 is further improved at the corner frequencies (e.g., 76 GHz, 80 GHz) such that the gain distribution is more uniform compared to the realized gain achieved with the tilted via wall alone.

Figure 8:
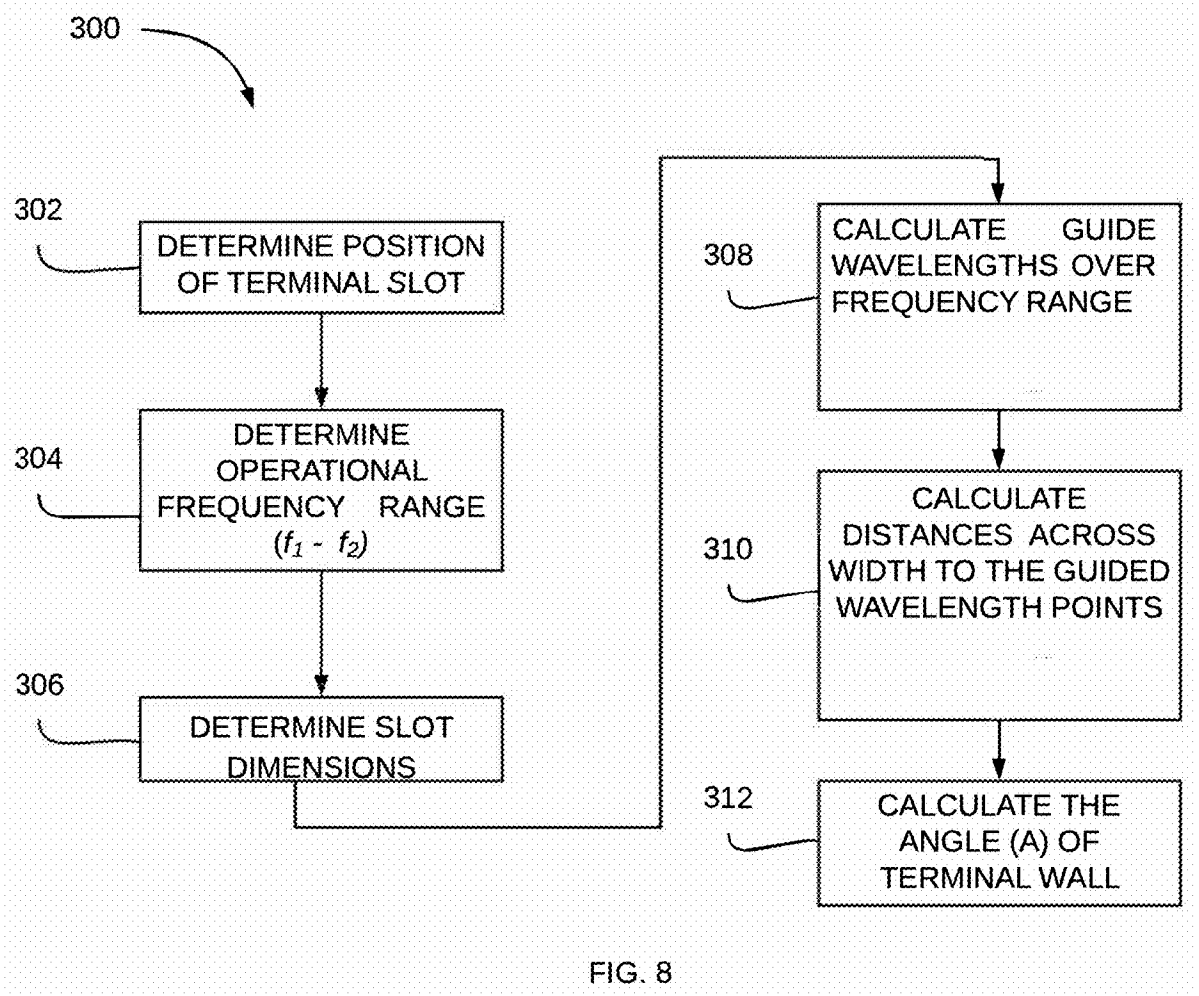
FIG. 8 illustrates a flow diagram of a process for designing a waveguide with a multi-frequency electromagnetic feed line, according to implementations of the subject technology.

FIG. 8 illustrates a flow chart of a process 300 for designing a waveguide 192 with a multi-frequency electromagnetic feed line, according to implementations of the subject technology. For explanatory purposes, the example process 300 is primarily described herein with reference to the waveguide 192 of FIG. 7; however, the example process 300 is not limited to the waveguide 192 of FIG. 7, and the example process 300 can be performed by one or more other waveguides, such as the waveguide 200 of FIG. 5. Further for explanatory purposes, the blocks of the example process 300 are described herein as occurring in serial, or linearly. However, multiple blocks of the example process 300 can occur in parallel. In addition, the blocks of the example process 300 can be performed in a different order than the order shown and/or one or more of the blocks of the example process 300 are not performed. In some implementations, the waveguide 192 has an angled termination construct 188 that is arranged in the waveguide 192 according to a tuned distance, a, which defines the distance between an end of the terminal slot 195 and the angled termination construct 188.

The process 300 begins at step 302, where the position of the slots, or discontinuities, for the waveguide 192 are determined. Next, at step 304, the operational frequency range (e.g., $f_1$-$f_2$) for the waveguide 192 is determined. Subsequently, at step 306, the slot dimensions are determined to achieve a desired performance from each slot. For example, the slot length along the x-axis may vary between the slots such that the slot lengths increase toward the center of the waveguide and decrease toward the edges of the waveguide. Next, at step 308, the guide wavelength values for corresponding frequencies in the determined operational frequency range are calculated. Subsequently, at step 310, the corresponding distances between one end of the terminal slot to different locations along a termination construct are calculated. In some aspects, the distances are calculated from the guide wavelength values. In some implementations, at step 312, the geometric angle, A, between the terminal wall (or edge) of the waveguide and the termination construct can be measured from the determined distances between the termination construct and the terminal slot. In various examples, the angle of the termination construct relative to the terminal edge of the waveguide may not exceed 45 degrees to prevent the wave from leaking outside of the termination construct of the waveguide.

Figure 9:
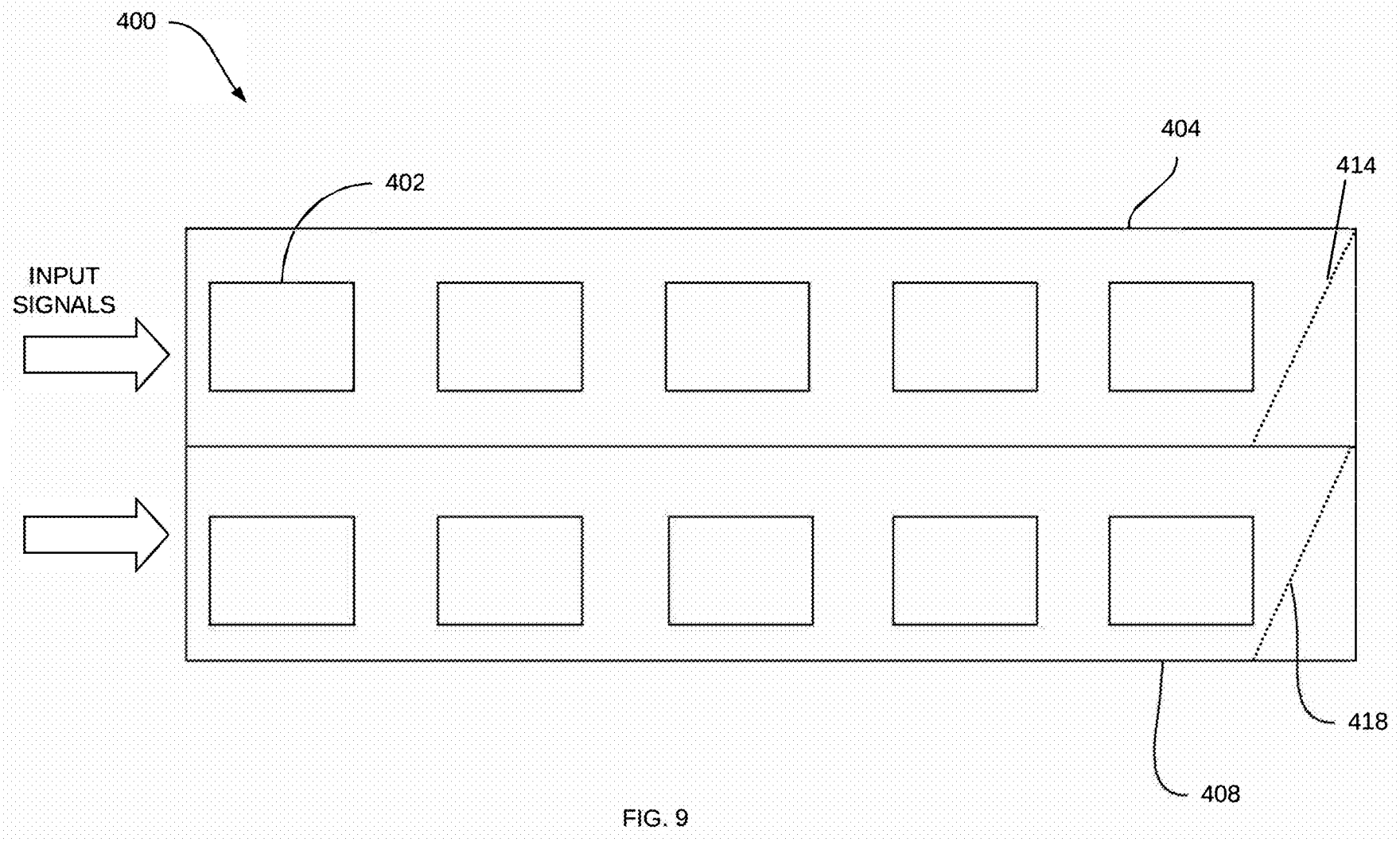
FIG. 9 illustrates a schematic diagram of a device incorporating multi-frequency electromagnetic feed lines, according to implementations of the subject technology.

FIG. 9 illustrates a device 400 incorporating waveguides 404, 408, where each of the waveguides 404, 408 are multi-frequency electromagnetic feed lines having termination constructs 414, 418, respectively, at tilted angles relative to terminal edges of the waveguides, thus enabling in-phase slot operation of the waveguides over a range of frequencies. In some implementations, the slots (e.g., 402) in the waveguides 404 and 408 are tapered such that the dimensions of the slots increase toward the center of the waveguide and decrease toward the edges of the waveguide. In some examples, the waveguides 404 and 408 are arranged adjacent to one another. In other examples, the waveguides 404 and 408 are coupled to one another along the length of the waveguides. The waveguides 404 and 408 may be fed from an input end (opposite to the terminal end) and are terminated at the terminal end in some implementations, or may be fed from a center of the waveguides (not shown) in other implementations.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Furthermore, to the extent that the term "include," "have," or the like is used in the description or the claims, such term is intended to be inclusive in a manner similar to the term "comprise" as "comprise" is interpreted when employed as a transitional word in a claim.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features that are described in this specification in the context of separate implementations can also be implemented in combination in a single implementation. Conversely, various features that are described in the context of a single implementation can also be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. Moreover, the separation of various system components in the aspects described above should not be understood as requiring such separation in all aspects, and it should be understood that the described program components and systems can generally be integrated together in a single hardware product or packaged into multiple hardware products. Other variations are within the scope of the following claim.

What is claimed is:

1. A waveguide, comprising:

a plurality of slots arranged laterally along a length of the waveguide that corresponds to a first axis, the plurality of slots configured to radiate electromagnetic signaling from an input end of the waveguide to a terminal end of the waveguide; and a plurality of vias arranged proximate to the terminal end of the waveguide in a predetermined angle relative to a second axis orthogonal to the first axis, the plurality of vias configured to terminate the plurality of slots for different frequencies of an operating frequency band, wherein a first slot of the plurality of slots that is arranged closest to the terminal end has varying distances to different vias of the plurality of vias.

2. The waveguide of claim 1, wherein a first end of the plurality of vias is arranged closest to the first slot while a second end of the plurality of vias that is opposite to the first end is arranged furthest to the first slot.

3. The waveguide of claim 1, wherein the predetermined angle corresponds to a non-orthogonal angle in a range of 0 degrees to 45 degrees.

4. The waveguide of claim 1, wherein the predetermined angle is increased proportional to an increasing number of frequencies in the operating frequency band to provide an increased range of varying distances to the first slot along the first axis.

5. The waveguide of claim 1, wherein the plurality of vias are coupled to a ground plane disposed in the waveguide to allow electromagnetic radiation from each of the plurality of slots at the different frequencies in the operating frequency band to terminate to ground through the plurality of vias.

6. The waveguide of claim 1, wherein the plurality of slots are equidistant from one another along the first axis.

7. The waveguide of claim 6, wherein the plurality of slots are separated by a fixed distance to provide periodicity within the plurality of slots.

8. The waveguide of claim 1, wherein the plurality of slots are staggered from one another along the second axis.

9. The waveguide of claim 1, wherein the plurality of slots have dimensions that are determined based at least on an operational frequency of the waveguide.

10. The waveguide of claim 9, wherein the plurality of slots have different dimensions along the first axis.

11. The waveguide of claim 9, wherein the plurality of slots are tapered along the first axis.

12. The waveguide of claim 9, wherein the dimensions of the plurality of slots increase toward a center of the waveguide and decrease toward opposing edges of the waveguide.

13. The waveguide of claim 1, wherein first slots of the plurality of slots arranged proximate to opposing edges of the waveguide have dimensions that are smaller than second slots of the plurality of slots arranged at or proximate to the center of the waveguide.

14. An electromagnetic feed line, comprising:

a plurality of slots arranged laterally along a length of the waveguide that corresponds to a first axis, the plurality of slots configured to radiate electromagnetic signaling from an input end of the waveguide to a terminal end of the waveguide; and a termination construct arranged proximate to the terminal end of the waveguide and configured to terminate the plurality of slots for different frequencies of an operating frequency band, wherein a first slot of the plurality of slots that is arranged closest to the terminal end has varying distances to different locations on the termination construct.

15. The electromagnetic feed line of claim 14, wherein the termination construct is a linear length of vias at a non-orthogonal angle relative to a second axis orthogonal to the first axis.

16. The electromagnetic feed line of claim 14, wherein a first end of the termination construct is arranged closest to the first slot while a second end of the termination construct that is opposite to the first end is arranged furthest to the first slot.

17. The electromagnetic feed line of claim 14, wherein:

a first location on the termination construct along the first axis is separated from one end of the first slot by a first distance and a second location on the termination construct is separated from the one end of the first slot by a second distance along the first axis, the first distance is different from the second distance, and the first distance corresponds to a first frequency and the second distance corresponds to a second frequency different from the first frequency.

18. The electromagnetic feed line of claim 14, wherein each of the varying distances between the first slot and the termination construct corresponds to a different frequency within the operating frequency band.

19. A method of fabricating a waveguide, the method comprising:

determining a position of each of a plurality slots in a waveguide, the plurality of slots being positioned laterally along a length of the waveguide that corresponds to a first axis, the plurality of slots being formed in a substrate of the waveguide for radiating electromagnetic signaling from an input end of the waveguide to a terminal end of the waveguide;

determining an operational frequency range for the waveguide;

determining dimensions for each of the plurality of slots to achieve a desired performance from each slot in the plurality of slots;

calculating guide wavelength values for corresponding frequencies in the determined operational frequency range; and calculating corresponding distances between one end of a terminal slot in the plurality of slots to different locations along a termination construct arranged proximate to the terminal end, the termination construct arranged in a tilted angle relative to a second axis orthogonal to the first axis, the termination construct being formed in the substrate for terminating the plurality of slots at different frequencies of the operational frequency range, wherein a first slot of the plurality of slots that is arranged closest to the terminal end has varying distances to the different locations on the termination construct.

20. The method of claim 19, further comprising measuring a geometric angle between the terminal edge of the waveguide and the termination construct from the corresponding distances between the termination construct and the terminal slot.

* * * * *